United States Patent [19]

Turner

[11] 4,159,670

[45] Jul. 3, 1979

[54] HANDGUN

[76] Inventor: Laurence E. Turner, 6 Woodward Ave., Norwalk, Conn. 06854

[21] Appl. No.: 803,140

[22] Filed: Jun. 3, 1977

[51] Int. Cl.[2] ..... F41D 7/04

[52] U.S. Cl. ..... 89/155; 42/71 P

[58] Field of Search ..... 42/1 R, 1 J, 15, 39.5, 42/71 R, 71 P, 59, 60, 65; 89/1 R, 1 N, 27 R, 27 F, 33 MC, 136, 155–157; 227/9–11

[56] References Cited

U.S. PATENT DOCUMENTS

| | | | |
|---|---|---|---|
| 2,705,323 | 4/1955 | Bossong | 227/11 |
| 3,632,032 | 1/1972 | Termet | 227/10 |
| 3,805,433 | 4/1974 | Passer | 227/9 |

FOREIGN PATENT DOCUMENTS

| | | | |
|---|---|---|---|
| 2258166 | 7/1973 | Fed. Rep. of Germany | 89/155 |
| 554051 | 1/1957 | Italy | 227/10 |
| 263621 | 1/1927 | United Kingdom | 89/27 F |

*Primary Examiner*—Stephen C. Bentley
*Attorney, Agent, or Firm*—Martin Novack

[57] ABSTRACT

A housing is provided, the housing including a grip portion having an aperture therein to receive the fingers of a hand and a frontal breech-enclosing portion disposed forwardly of the grip portion. A breech is mounted in the frontal housing portion. A barrel is mounted forwardly of the breech, the breech and barrel being aligned with the approximate vertical center of the aperture of the gripping portion. A hammer is mounted behind the breech. A thumb actuated trigger assembly is provided, the trigger assembly including a thumb trigger mounted above and behind the aperture and a trigger linkage adapted to mechanically actuate the hammer upon depression of the thumb trigger. The alignment of the breech and barrel with the approximate center of the gripping fingers effectively places the force of the recoil in alignment with the bone structure of the arm, thereby reducing the pivoting which can be caused by recoil in conventional handguns. In a preferred embodiment of the invention the breech comprises a pair of breech plates which are movably mounted in the frontal housing portion, the breech plates being in normally contiguous relationship and having bottom arcuate surfaces which align with the top edge of the barrel.

25 Claims, 12 Drawing Figures

HANDGUN

BACKGROUND OF THE INVENTION

This invention relates to firearms and, more particularly, to an improved handgun.

There are a number of existing disadvantages in conventional handgun configurations to which the present invention is addressed. The handle of a conventional handgun is grasped by the fingers and thumb of the hand and the barrel typically has an axis which is above a line defined by the hand and forearm. Upon firing, recoil causes a pivoting action of the barrel about a pivot which is defined generally by the intersection of the grip or handle and the axis of the barrel. This results in the barrel undesirably angling upward at its forward end which can lead to inaccuracies and unpreparedness for a subsequent shot. One consequence of this phenomenon has been the inconvenient but necessary adoption of a two-handed grip during firing of the handgun so as to achieve a firmer gripping action and reduce the forces tending to urge the barrel off the target line.

A further disadvantage of conventional handgun designs pertains to the manner in which spent shells are ejected from the weapon. In particular, the shells generally travel upward and outward upon ejection. This may be undesirable in certain situtations, but existing configurations would render it difficult to have ejection be effected in a more efficient manner.

It is an object of the present invention to provide a handgun which is responsive to the prior art problems as set forth, and to generally provide a novel handgun which exhibits overall operational advantage.

SUMMARY OF THE INVENTION

The present invention is directed to a handgun having novel features. A housing is provided, the housing including a grip portion having an aperture therein to receive the fingers of a hand and a frontal breech-enclosing portion disposed forwardly of the grip portion. A breech is mounted in the frontal housing portion. A barrel is mounted forwardly of the breech, the breech and barrel being aligned with the approximate vertical center of the aperture of the gripping portion. A hammer is mounted behind the breech. Finally, a thumb actuated trigger assembly is provided, the trigger assembly including a thumb trigger mounted above and behind the aperture and a trigger linkage adapted to mechanically actuate the hammer upon depression of the thumb trigger. The alignment of the breech and barrel with the approximate center of the gripping fingers effectively places the force of the recoil in alignment with the bone structure of the arm, thereby reducing the pivoting which can be caused by recoil in conventional handguns.

In a preferred embodiment of the invention the breech comprises a pair of breech plates which are movably mounted in the frontal housing portion, the breech plates being in normally contiguous relationship and having bottom arcuate surfaces which align with the top edge of the barrel. In this embodiment, a generally cylindrical rotor is rotatably mounted in the frontal housing portion below the breech plates. The rotor has a plurality of cartridge-seating grooves therein which are oriented parallel to the axis of the barrel. The rotor is proportioned such that its outer periphery is in alignment with the barrel axis, and the cartridge-seating grooves have an arcuate shape and are proportioned to coincide with the lower edge of the barrel. A magazine is disposed above the frontal housing portion for receiving cartridges. An ejection opening is located in the frontal housing portion at a position corresponding to one of the cartridge-seating grooves when another of these grooves is aligned with the barrel. Preferably, three cartridge-seating grooves are provided in the rotor 120° apart. Means, actuated by the firing of a cartridge held between the breech plates and one of the grooves, are provided for rotating the rotor and temporarily separating the breech plates. In this manner, the spent shell of the cartridge is rotated to the position of the ejection opening and a cartridge from the magazine is received between the separated breech plates at another of the cartridge-seating grooves.

In the preferred form of the invention, the means for actuating the rotor and breech plates comprises a piston assembly which is mounted in a chamber disposed beneath the barrel and having a communication port to the barrel to receive exhaust gases therfrom. Means are coupled to a piston shaft for locking the breech plates and the rotor when the piston is in its forward position. The rearward stroke of the piston, actuated by the exhaust gases, actuates rotation of the rotor, separation of the breech plates, and unlocking of breech plate and rotor locks. Also, a communicating passage through the piston shaft is provided for communicating exhaust gases from the barrel to ports in the rotor's cartridge-seating grooves. The gases cause ejection of the spent cartridge in an advantageous downward and outward motion. The piston shaft which travels rearwardly through a central bore in the rotor, also serves to cock the hammer for the next shot.

Further features and advantages of the invention will become more readily apparent from the following detailed description when taken in conjunction with the accompanying drawings.

DESCRIPTION OF THE PREFERRED EMBODIMENT

Figure 1:
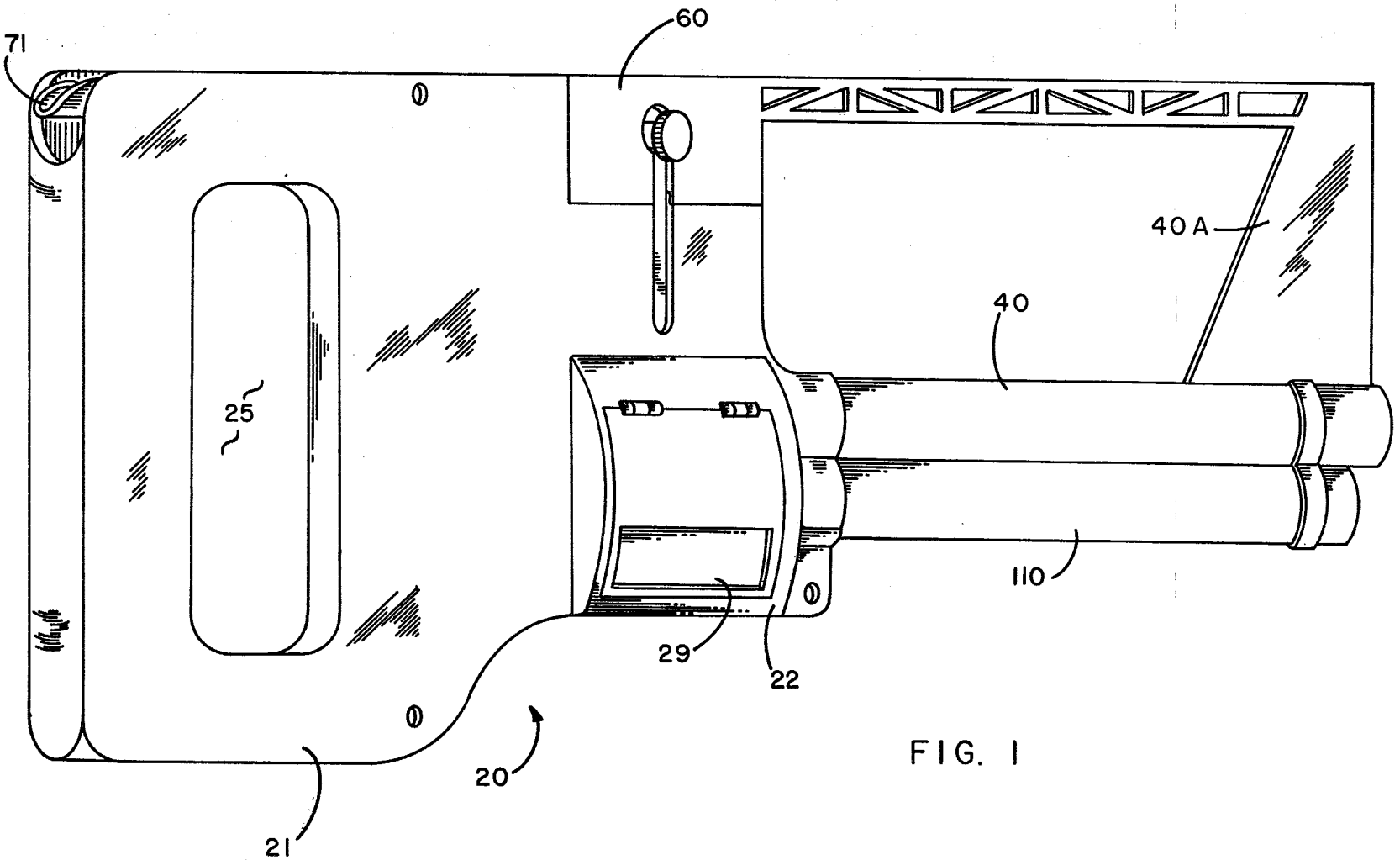
FIG. 1 is a side elevational perspective view of handgun in accordance with an embodiment of the invention.
Figure 2:
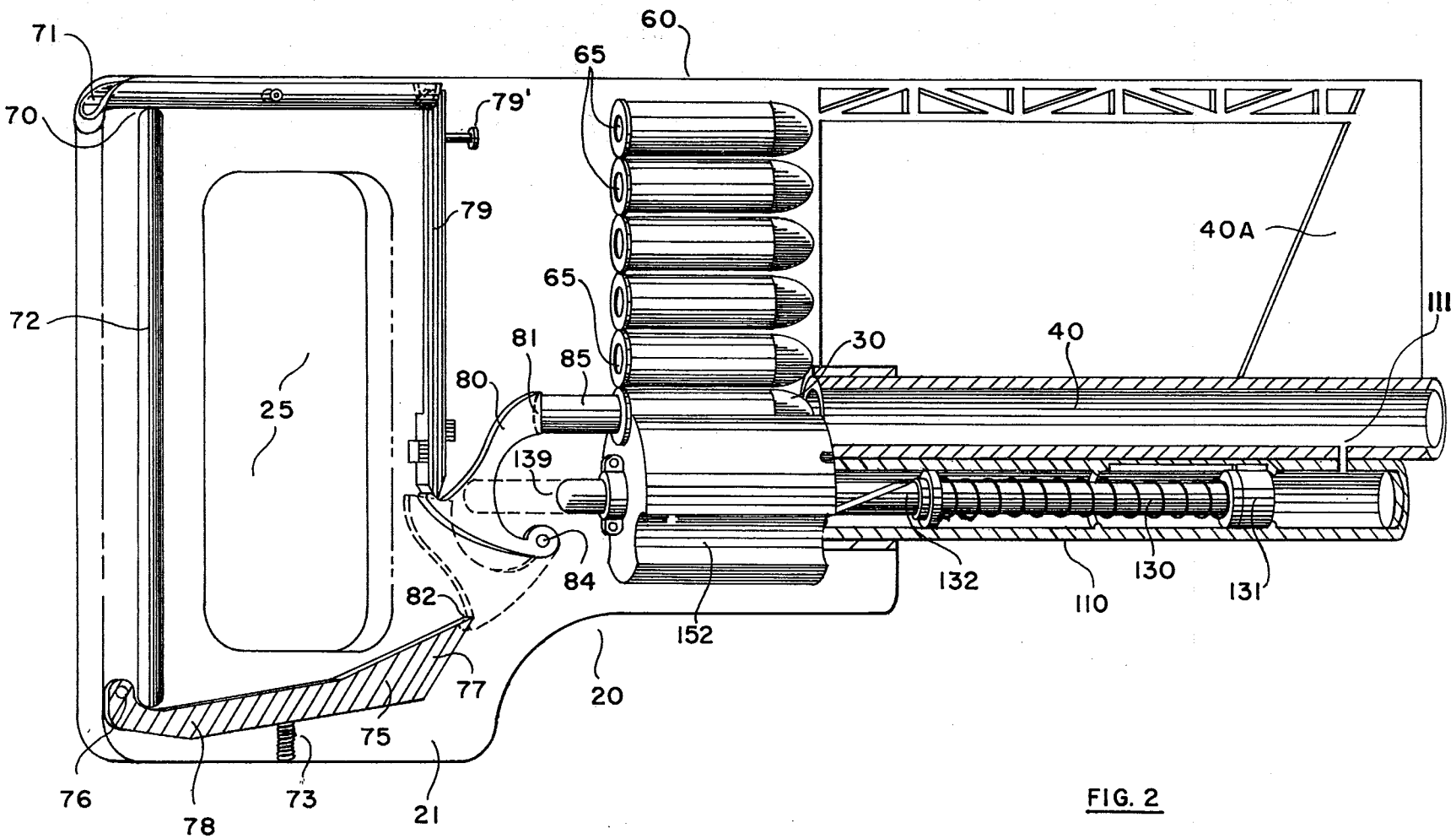
FIG. 2 is a cutaway view of the handgun of FIG. 1, showing the internal workings of portions thereof.

Referring to FIGS. 1 and 2, there is shown a handgun in accordance with an embodiment of the invention. A housing, referred to generally by the reference numeral 20, includes a grip portion 21 and a frontal breech-enclosing frontal portion 22. A breech 30, to be described, is enclosed within the housing frontal portion 22, and a magazine 60 is located over the breech 30 and includes a magazine spring and follower, to be described. Cartridges 65 are shown as loaded in the magazine FIG. 2. A barrel 40 is mounted forwardly of the breech, such as by threading (not shown) which engages complementary threading (not shown) in the frontal housing portion 22. A sight mount 40A is mounted on the front of the barrel. The grip portion 21 of the housing 20 has an aperture 25 therin, the aperture being proportioned to receive the fingers of a hand. The breech 30 and barrel 40 are aligned with the approximate vertical center of the aperture 25, so that during gripping of the weapon, the breech and barrel are aligned approximately with the middle fingers of the hand and, thereby, generally aligned with the bone structure of the arm of the person gripping the handgun. A firing pin assembly 85 is mounted behind the breech 30 and a hammer 80 is pivotally mounted (at 84) in the lower part of the grip portion 21 of housing 20, the hammer extending upwardly, as shown, such that its head 81 can engage a firing pin mechanism 85. The hammer, which has a coil spring (not shown) on its pivoting pin, is illustrated in its cocked position in dashed line. A sear 75 is pivotally mounted (at 76) beneath the hammer and has a forwardly extending arm 77 which normally engages a rear flange 82 of hammer 80 to prevent the pivoting thereof. A thumb-actuated trigger assembly 70 is mounted rearwardly of the aperture 25 in the gripping portion 21 of housing 20. The trigger assembly 70 includes a thumb-actuated trigger 71 which is disposed above and behind the aperture 25, a plunger 72 which is coupled to the trigger 71 and extends downwardly therefrom, and a return spring 73 which biases the trigger 71 and plunger 72 in a normally upward position. The plunger 72 is adapted, when the thumb trigger 71 is depressed, to engage the rear portion 78 of the sear 75. Pivoting of the sear 75 releases the hammer 80 to strike a firing pin in firing pin assembly 85 and fire a cartridge 65 in the breech 30. The trigger 71 also engages and lifts the trigger sear 79 so that the hammer 80 has clearance to the firing pin, except when safety (not shown) locks the trigger sear.

A cylindrical piston-carrying chamber 110 is mounted beneath the barrel and communicates at its rear end with the front of the frontal housing portion 22. The barrel has a small port 111 therein which communicates with the cylindrical chamber so that exhaust gases enter the cylindrical chamber immediately after the weapon has been fired. A piston assembly 130 is mounted in the cylindrical chamber 110 and is adapted to be actuated by the exhaust gases. The piston assembly 130 includes a piston head 131 and a piston shaft 132 attached to the piston head.

Figures 3, 3A, 3B:
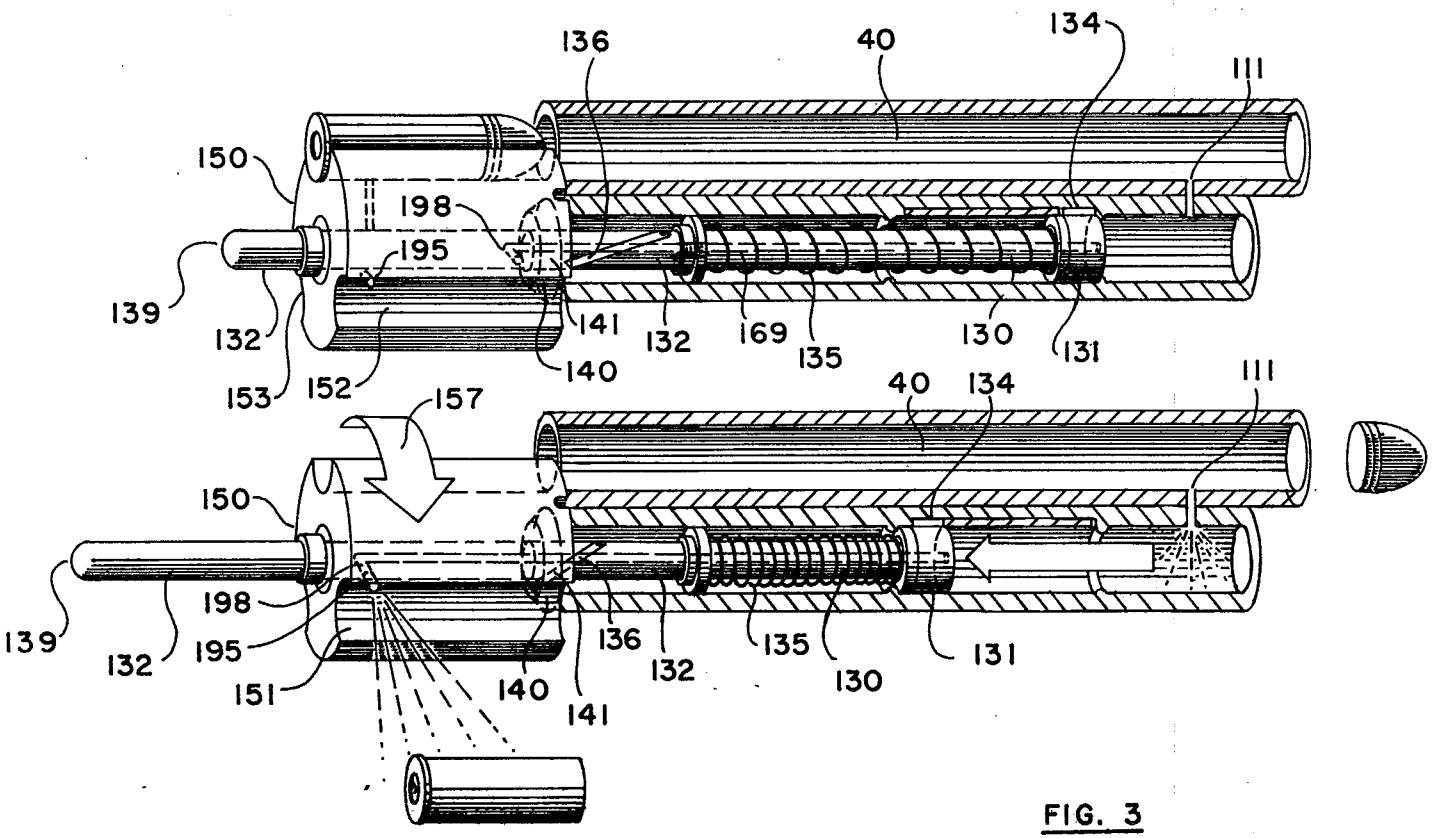
FIGS. 3A and 3B are side elevational cutaway views of the piston assembly and rotor of the embodiment of FIG. 1, with FIG. 3A showing a cartridge in position before firing, and FIG. 3B showing the manner in which the spent shell is ejected after firing.
Figure 4E:
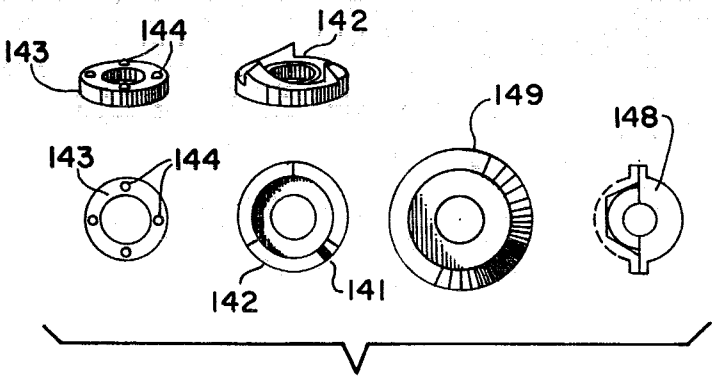
FIG. 4E is an exploded view of the gearing unit which is shown in conjunction with the rotor of FIG. 4D.
Figure 4D:
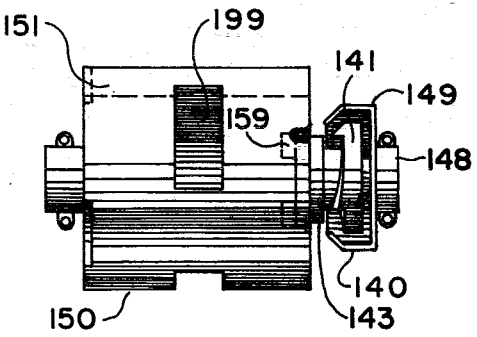
FIGS. 4B, 4C, and 4D are front, rear, and side views, respectively, of the rotor.
Figure 4A:
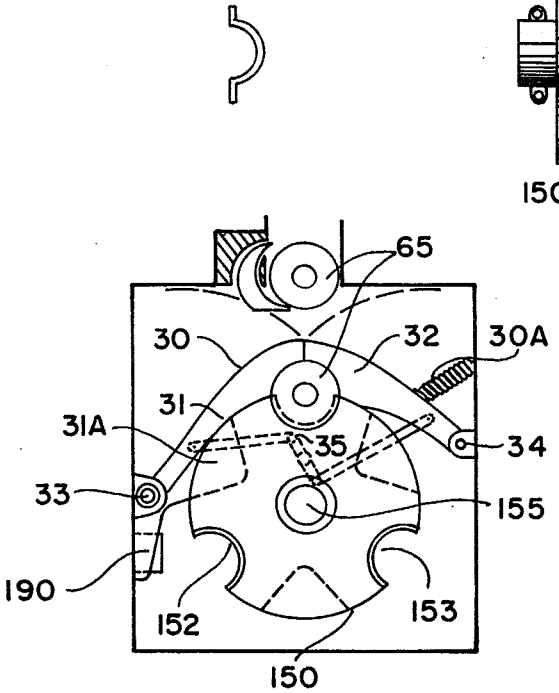
FIG. 4A is a cross-sectional view showing the rotor and breech plates.
Figure 4B:
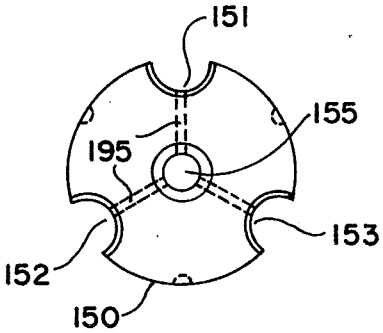
Figure 4C:
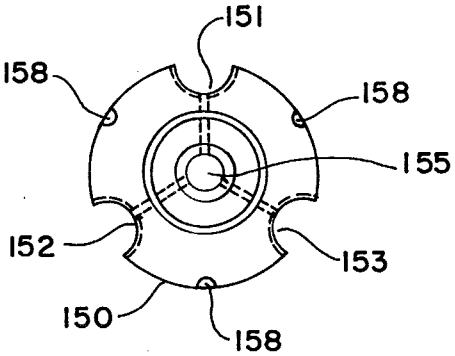
Figure 5:
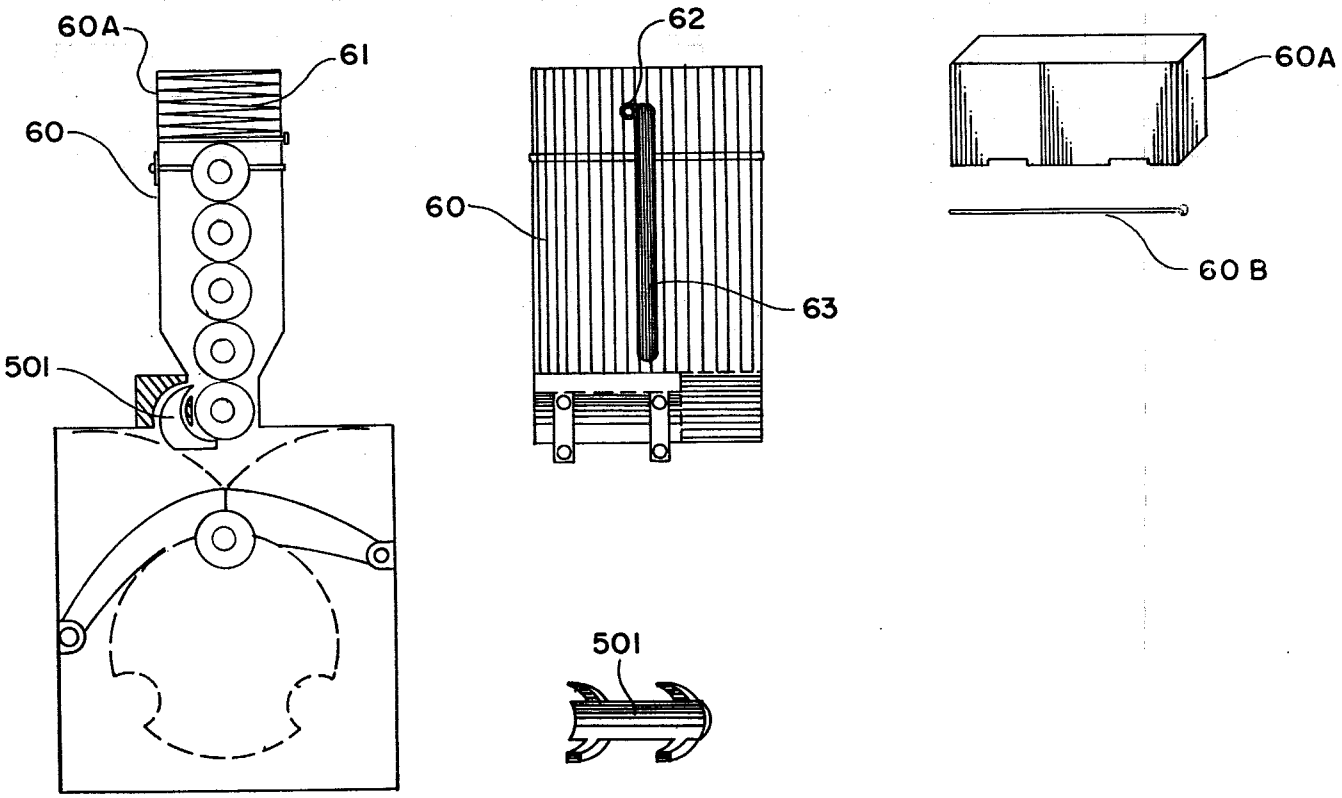
FIG. 5 illustrates operation of the magazine and shows parts thereof in exploded form.
Figure 7:
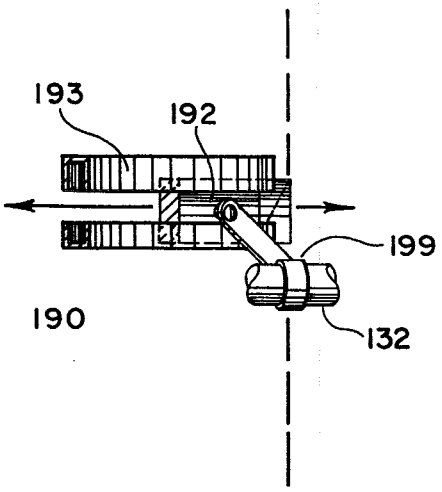
FIG. 7 is a side elevational view of the breech lock unit in accordance with the embodiment of FIG. 1.
Figure 6:
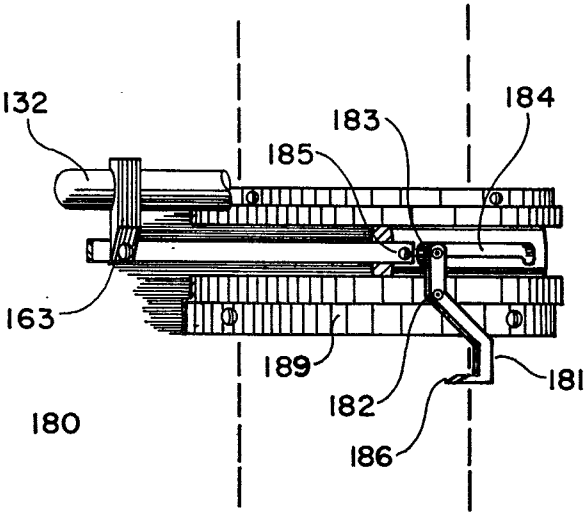
FIG. 6 is a side elevational view of the rotor lock mechanism in accordance with the embodiment of FIG. 1.

The breech 30 includes a pair of breech plates 31 and 32 (FIGS. 4 and 5) which temporarily separate, in a manner to be described, to receive a cartridge from the magazine 60, and then converge to form an enclosure over the top of the received cartridge. A rotor 150 (FIGS. 2, 3 and 4) is rotatably mounted in the frontal housing portion 21 below the breech plates 31 and 32. The rotor is generally cylindrical in shape and has a plurality of cartridge-seating grooves therein, preferably three grooves designated 151, 152 and 153, the grooves being oriented parallel to the axis of the barrel 40. The rotor 150 is proportioned such that its outer periphery is in alignment with the barrel axis, and the grooves 151–153 are proportioned to receive and hold the bottom portion of a crartridge, in conjunction with the breech plates 31 and 32, such that the cartridge is in alignment with the barrel 40. In FIG. 3 the piston shaft 132 is proportioned to be long enough to extend through a cylindrical aperture 155 in the center of the rotor 150 (FIG. 3). The rearmost end of the piston shaft has a cocking tip 139 which serves to cock the hammer upon the rearward stroke of the piston. The piston head 131 has a small bar 134 extending from the top therof, the bar 134 riding in a groove in the top of the cylindrical chamber so as to prevent rotation of the piston head or rod. A coil spring 135 is mounted on the piston shaft and serves as a return spring to return the piston to its forward position after the rearward stroke thereof. A cam 136 (FIG. 3) is formed on the piston shaft. During the rearward stroke of the piston, the cam 136 moves a cam follower 141 in a gearing unit 140 (FIGS. 4D and 4E) which is rotatably mounted on the piston. The gearing unit 140 is mounted in a bearing housing 149 which, in turn, is affixed to the frontal housing portion 22 (by means not shown). The bearing housing is between a securing ring 148 and a spacer ring 143 with illustrated tall bearings 144. The gearing unit 140 has a gear 142 extending rearwardly therefrom. (The cam follower 141 is a slot in gear 142.) During the rearward stroke of the piston shaft 132 the cam 136 operating on its associated cam follower 141 causes the gear 142 to move rearwardly and rotatably engage a complementary toothed surface 159 in the front portion of rotor 150. The cam 136 is oriented so as to effect 120° of rotation of the gear 142 and the rotor 150, the rotor turning clockwise (as viewed from the rear) as shown in FIG. 3B by arrow 157. During return of the piston shaft 132 to its forward position (by action of coil spring 135) the gear 142 disengages from the teeth 159 in the rotor 150 so that the rotor does not rotate backwards during the return forward stroke of the piston, in the manner of a "free-wheeler." A rotor locking unit 180 and a breech locking unit 190 are coupled to the rear end of piston shaft 132, as shown in FIGS. 6 and 7, respectively. When the piston shaft 132 returns to its forward position after a stroke, the locking units 180 and 190 serve to lock the rotor and the breech plates so that the newly inserted cartridge is held firmly in place between the breech plates and a cartridge-seating groove in preparation for firing the next shot. The top of one breech plate serves as a tripping element which interacts with a suitable feed regulator 501 (FIG. 5) of the magazine to allow ejection of a cartridge from the spring loaded magazine 60 while the breech plates are separated. The rotor locking unit 180 includes a lever 181 which is pivotally mounted at 182 to bracket 189 which is secured to the housing. The top end of the lever 181 has a small guide pin 183 protruding sidewardly therefrom, the pin riding in a slot 184 of a plate 185 which is mounted to piston shaft 132 by arm 163. In the diagram of FIG. 6, the piston is assumed to be at its forward rest position and the action of slot 184 upon pin 183 causes the bottom of lever 181 to tilt forward. The bottom of the lever has a small head 186 formed thereon, the head 186 engaging one of the lockwells 158 in the rotor 150 (FIG. 4). When the piston starts its rearward stroke, the bottom of lever 181 will tilt rearwardly as the lever pivots due to the motion of the pin 183 in slot 184. The rearward stroke of the piston shaft 132 also releases breech lock 190. The breech lock 190 includes a stop flange 192 which rides in a track 193 that is mounted to the housing. The stop flange is connected to shaft 132 by coupling 199. When the piston is in its forward position, the front edge of stop flange 192 overlaps a foot portion of breech plate 31 (see FIG. 4A) to prevent the opening thereof.

The illustrations of FIGS. 3 and 4 are particularly referred to for gaining an understanding of the coordinated operation of the rotor 150 and the breech plates 31 and 32. The rotor 150 is rotatably mounted on the piston shaft 132. The piston head and rod have a narrow elongated central aperture 169 therethrough which extends from the piston head to the portion of the piston shaft which passes through the rotor, as shown in dashed line in FIG. 3. A communicating exhaust port 198 is formed in the piston shaft 132, the port 198 being at an angular orientation on the shaft which is 120° from the top thereof; i.e. at an angular position which corresponds to the position of one of the cartridge-seating grooves (151) in the rotor 150. Each of the cartridge-seating grooves in the rotor 150, in turn, has an exhaust port 195 which communicates with the port 198 in the rotor 150 (FIG. 3B). However, exhaust gases from the front of cylindrical chamber 110 communicate only with the port in the particular groove which is at the angular position (i.e. the ejection position) corresponding to the angular position of the port 198 in the piston shaft 132. The breech plates are pivotally mounted in the frontal housing portion 21 as shown at 33 and 34, and are also coupled at one end by the hinge 35 which causes breech plate 32 to open and close in concert with breech plate 31 (shown in dashed line in FIG. 4A since the hinge is in front of the rotor). The inner surface of breech plate 31 has a cam formed thereon, labeled with reference numeral 31A. At an axial position corresponding to the location of cam 31A, the rotor has circumferential grooves 199 formed therein (see FIG. 4D). The grooves 199 are shaped such that when the rotor is in one of its three "rest" positions (with one of the cartridge-seating grooves at the top position) the breech plates 31 and 32 will sit flush on the rotor in their contiguous or closed position during which a cartridge is held for firing. The grooves 199 become successively shallower (FIG. 4D) so that, as the rotor 150 rotates 120° the cam 31A riding in the shallower groove portions cause the breech plates 31 and 32 to temporarily open. During the remainder of a 120° excursion, the grooves 199 are proportioned to become deeper so that when the next cartridge seat groove is at the top position the breech plates 31 and 32 will close by action of breech return spring 30A.

The sequence of operation of the described weapon is as follows: The magazine 60 is loaded with cartridges and the piston shaft is initially moved manually rearward to cock the hammer. The magazine 60 (FIG. 5) includes a spring 61 and a follower 62 which rides in slot 63. (The top portion 60A of the magazine is hinged with hinge pin 60B to facilitate loading with cartridges.) Assume that a first cartridge is seated between the cartridge seating groove 152 of the rotor 150 and the closed breech plates 31 and 32. The handgun is gripped with the fingers through the aperture 25, it is aimed, and the trigger 71 is depressed with the thumb. The plunger 72 engages the rear portion 78 of sear 75, releasing the hammer. The hammer strikes the firing pin mechanism 85, thereby firing the cartridge. Exhaust gases enter the gas cylinder 110 via port 111 and force the piston head and piston shaft into their rearward stroke. The initial rearward motion of the piston releases the rotor lock 180 and the breech lock 190. As the piston moves rearwardly, the cam 136 formed thereon causes a rotational motion of the gearing unit 140. The teeth on gear 142 engage the rotor 150 and cause rotation thereof. As the rotor begins to turn, the breech plates open as the cam 31A rides in shallower portion of the grooves 199. As the rotor reaches the end of its 120° excursion, the port 198 in the rotor aligns with the port 195 in the piston shaft 132. A portion of the exhaust gases travels through the aperture 169 in the piston head and piston shaft, and the pressure of this exhaust gas through the port 195 in the rotor forces the spent shell out of the particular cartridge-seating groove which is now at the ejection position below the hinged flap 28 (FIG. 1) in the frontal housing portion 21. The spent cartridge is ejected through the opening 29 in the flap 28 (FIG. 1). The rearward stroke of the piston 132 also serves to cock the hammer 80 via action of the cocking tip 139. With the exhaust gases released, the action of spring 135 returns the piston assembly to its forward rest position and this, in turn, causes engagement of the rotor lock 180, and activates the locking mechanism via feed regulator 501. The hammer has been cocked and the piece is again prepared to fire.

The invention has been described with reference to a particular embodiment, but variations within the spirit and scope of the invention will occur to those skilled in the art. For example, it will be understood that alternate techniques can be utilized for translating the stroke of the piston shaft to rotational motion of the rotor 150. Also, suitable safeties and sights can be provided, as is known in the art.

I claim:

1. A handgun, comprising:

a housing including a grip portion having an aperture therein to receive the fingers of a hand and a frontal breech-enclosing portion disposed forwardly of said grip portion;

a breech mounted in said frontal housing portion;

a barrel mounted forwardly of said breech, said breech and barrel being aligned with the approximate vertical center of the aperture of said gripping portion;

a magazine for receiving a stack of horizontally oriented cartridges disposed above said frontal housing portion and communicating with said breech;

a sight mounted in raised relation to said barrel and aligned with the top of said magazine and the top of said gripping portion;

a hammer mounted behind said breech; and a thumb-actuated trigger assembly including a thumb trigger mounted above and behind said aperture and a trigger linkage adapted to mechanically actuate said hammer upon depression of said thumb trigger.

2. A handgun, comprising:

a housing including a grip portion having an aperture therein to receive the fingers of a hand and a frontal breech-enclosed portion disposed forwardly of said grip portion;

a breech mounted in said frontal housing portion;

a barrel mounted forwardly of said breech, said breech and barrel being aligned with the approximate vertical center of the aperture of said gripping portion;

said breech including a pair of breech plates movably mounted in said frontal housing portion, said breech plates being in normally contiguous relationship and having bottom arcuate surfaces which align with said barrel;

a hammer mounted behind said breech;

a thumb-actuated trigger assembly including a thumb trigger mounted above and behind said aperture and a trigger linkage adapted to mechanically actuate said hammer upon depression of said thumb trigger;

a generally cylindrical rotor rotatably mounted in said frontal housing portion below said breech plates, said rotor having a plurality of cartridge-seating grooves therein which are oriented parallel to the axis of the barrel, the rotor being proportioned such that its outer periphery is in alignment with the barrel axis, said cartridge-seating grooves having an arcuate shape and being proportioned to coincide with the lower edge of the barrel;

an ejection opening located in said frontal housing portion at a position corresponding to one of said cartridge-seating grooves when another of said grooves is aligned with said barrel; and means, actuated by the firing of a cartridge held between said breech plates and one of said cartridge-seating grooves, for rotating said rotor and temporarily separating said breech plates, whereby the spent casing of a cartridge is rotated to the position of said ejection opening and a cartridge from said magazine is received between the temporarily separated breech plates at another of said cartridge-seating grooves.

3. The gun as defined by claim 2 wherein said plurality of cartridge-seating grooves in said barrel comprises three such grooves located 120° apart.

4. The gun as defined by claim 2 further comprising an ejection port between said cartridge-seating grooves and a central aperture in said rotor; and means for communicating exhaust gases from said barrel to the port of the particular cartridge-seating groove located at the ejection opening.

5. The gun as defined by claim 3 further comprising an ejection port between said cartridge-seating grooves and a central aperture in said rotor; and means for communicating exhaust gases from said barrel to the port of the particular cartridge-seating groove located at the ejection opening.

6. The gun as defined by claim 2 wherein said means for rotating said rotor and temporarily separating said breech plates comprises:

a piston-carrying gas cylinder mounted beneath said barrel and having a communication port to said barrel to receive exhaust gases therefrom;

a piston assembly in said cylinder adapted for actuation by said exhaust gases, said piston assembly including a piston head and a piston shaft; and means coupled to said piston shaft for effecting rotation of said rotor and temporary separation of said breech plates upon a rearward stroke of said piston.

7. The gun as defined by claim 5 wherein said means for rotating said rotor and temporarily separating said breech plates comprises:

a piston-carrying gas cylinder mounted beneath said barrel and having a communication port to said barrel to receive exhaust gases therefrom;

a piston assembly in said cylinder adapted for actuation by said exhaust gases, said piston assembly including a piston head and a piston shaft; and means coupled to said piston shaft for effecting rotation of said rotor and temporary separation of said breech plates upon a rearward stroke of said piston.

8. The gun as defined by claim 7 further comprising biasing means for biasing said piston assembly to a forward rest position after the rearward stroke thereof.

9. The gun as defined by claim 8 wherein said piston shaft extends through the center of said rotor and is operative, upon its rearward stroke, to reset the hammer.

10. The gun as defined by claim 9 further comprising means coupled to the piston assembly for locking said breech plates when the piston assembly is in its forward rest position.

11. The gun as defined by claim 9 further comprising means coupled to said piston assembly for locking the rotor when the piston assembly is in its forward rest position.

12. The gun as defined by claim 10 further comprising means coupled to said piston assembly for locking the rotor when the piston assembly is in its forward rest position.

13. The gun as defined by claim 12 wherein said piston assembly includes means for communicating a portion of the exhaust gases which enter said gas cylinder with the aperture in said rotor.

14. A handgun, comprising:

a housing including a grip portion and a frontal breech-enclosing portion disposed forwardly of said grip portion;

a barrel mounted forwardly of said frontal housing portion;

a pair of breech plates movably mounted in said frontal housing portion, said breech plates being in normally contiguous relationship and having bottom arcuate surfaces which align with said barrel;

a generally cylindrical rotor rotatably mounted in said frontal housing portion below said breech plates, said rotor having a plurality of grooves therein which are oriented parallel to the axis of the barrel, the rotor being proportioned such that its outer periphery is in alignment with the barrel axis, said grooves having an arcuate shape and being proportioned to coincide with the lower portion of the barrel;

magazine means disposed above said frontal housing portion for receiving cartridges;

an ejection opening located in said frontal housing portion at a position corresponding to one of said rotor grooves when another of said rotor grooves is aligned with said barrel;

means, actuated by the firing of a cartridge held between said breech plates and one of said grooves, for rotating said rotor and temporarily separating said breech plates; whereby the spent casing of said cartridge is rotated to the position of said ejection opening.

15. The gun as defined by claim 14 wherein said plurality of cartridge-seating grooves in said barrel comprises three such grooves located 120° apart.

16. The gun as defined by claim 14 further comprising an ejection port between said cartridge-seating grooves and a central aperture in said rotor; and means for communicating exhaust gases from said barrel to the port of the particular cartridge-seating groove located at the ejection opening.

17. The gun as defined by claim 15 further comprising an ejection port between said cartridge-seating grooves and a central aperture in said rotor; and means for communicating exhaust gases from said barrel to the port of the particular cartridge-seating groove located at the ejection opening.

18. The gun as defined by claim 14 wherein said means for rotating said rotor and temporarily separating said breech plates comprises:

a piston-carrying gas cylinder mounted beneath said barrel and having a communication port to said barrel to receive exhaust gases therefrom;

a piston assembly in said cylinder adapted for actuation by said exhaust gases, said piston assembly including a piston head and a piston shaft; and means coupled to said piston shaft for effecting rotation of said rotor and temporary separation of said breech plates upon a rearward stroke of said piston.

19. The gun as defined by claim 17 wherein said means for rotating said rotor and temporarily separating said breech plates comprises:

a piston-carrying gas cylinder mounted beneath said barrel and having a communication port to said barrel to receive exhaust gases therefrom;

a piston assembly in said cylinder adapted for actuation by said exhaust gases, said piston assembly including a piston head and a piston shaft; and means coupled to said piston shaft for effecting rotation of said rotor and temporary separtion of said breech plates upon a rearward stroke of said piston.

20. The gun as defined by claim 19 further comprising biasing means for biasing said piston assembly to a forward rest position after the rearward stroke thereof.

21. The gun as defined by claim 20 wherein said piston extends through the center of said rotor and is operative, upon its rearward stroke, to reset the hammer.

22. The gun as defined by claim 21 further comprising means coupled to the piston assembly for locking said breech plates when the piston assembly is in its forward rest position.

23. The gun as defined by claim 21 further comprising means coupled to siad piston assembly for locking the rotor when the piston assembly is in its forward rest position.

24. The gun as defined by claim 22 further comprising means coupled to said piston assembly for locking the rotor when the piston assembly is in its forward rest position.

25. The gun as defined by claim 24 wherein said piston assembly includes means for communicating a portion of the exhaust gases which enter said gas cylinder with the center of said rotor.

* * * * *